US005503941A

United States Patent [19]

Pruyn

[11] Patent Number: 5,503,941

[45] Date of Patent: Apr. 2, 1996

[54] METAL FOAM

[75] Inventor: Wilhelmus A. Pruyn, Boxmeer, Netherlands

[73] Assignee: Stork Screens B.V., Boxmeer, Netherlands

[21] Appl. No.: 400,268

[22] Filed: Mar. 3, 1995

Related U.S. Application Data

[60] Continuation of Ser. No. 153,773, Nov. 17, 1993, abandoned, which is a division of Ser. No. 23,203, Feb. 25, 1993, abandoned.

[30] Foreign Application Priority Data

Feb. 26, 1992 [NL] Netherlands ..... 9200350

[51] Int. Cl.[6] ..... B32B 15/08; B32B 5/18

[52] U.S. Cl. ..... 428/613; 428/626; 428/935

[58] Field of Search ..... 428/613, 623, 428/626, 935

[56] References Cited

U.S. PATENT DOCUMENTS

| | | | |
|---|---|---|---|
| 2,434,775 | 1/1948 | Sosnick | 428/613 |
| 3,694,325 | 9/1972 | Katz et al. | 204/11 |
| 3,788,823 | 1/1974 | Wells | 428/613 |
| 4,436,591 | 3/1984 | de Hek | 205/75 |
| 4,713,277 | 12/1987 | Akiyama et al. | 428/613 |
| 4,882,232 | 11/1989 | Bugnet et al. | 428/613 |
| 5,282,951 | 2/1994 | Delmee | 205/75 |

OTHER PUBLICATIONS

Lowenheim, F. A., Electroplating, McGraw–Hill Book Co., NY, no month 1978, pp. 139–140, 216–221.

Lowenheim, F. A., Modern Electroplating, John Wiley & Sons, NY, no month 1974, pp. 17–21, 296–305.

*Primary Examiner*—John Zimmerman

*Attorney, Agent, or Firm*—Deveau, Colton & Marquis

[57] ABSTRACT

A method for the production of a metal foam is described.

To this end a suitable foam material (1)is provided, if necessary, with an electrically conducting covering layer (1') and then thickened by plating with metal in an electrolytic bath.

According to the invention the electrolytic bath used contains a brightener; in particular a chemical compound having the properties of a second class brightener.

Metal foam obtained by means of the method is also described.

7 Claims, 1 Drawing Sheet

METAL FOAM

This is a continuation of application Ser. No. 08/153,773 filed on Nov. 17, 1993, now abandoned, which is a divisional of application Ser. No. 08/023,203 filed on Feb. 25, 1993, now abandoned.

BACKGROUND OF THE INVENTION

The invention relates to a method for the production of a metal foam, in which method a suitable foam material is, if necessary, provided with an electrically conducting surface layer, after which the material is subjected to a metal deposition treatment in an electrolytic bath.

A method of this type is disclosed in EP-B1-0151064.

In said publication it is described that an electrically conducting surface layer is applied, in a first step, by cathode sputtering or ionic deposition on an organic support material of high porosity, while in a second step metal is deposited in a chemical and/or electrochemical step until the desired coating thickness is obtained.

It can be seen from said publication that the deposition of the electrically conducting surface layer can also take place in a chemical way, as is disclosed in the prior art.

Metal foam structures of this type have many fields of application:

The material can be used for the production of electrodes for electric accumulators or batteries as well as for electrodes for fuel cells or alternatively as electrode supports.

In addition, materials of this type can be employed as support materials for catalysts which are used in various chemical process units such as cracking plants and also in catalytic devices in motor vehicles.

Metal foam materials of this type can also be used for acoustic insulation.

The material as described in the above-mentioned publication has, in general, a metal deposit which is unsuitable for certain applications; thus, for example, the physical and mechanical properties will generally leave something to be desired.

To that end, the present application aims to provide a method of the indicated type which makes it possible to provide in particular the surface of the resulting metal foam with specific physical and/or chemical properties compared with the surface of a metal foam obtained by the method of the prior art.

SUMMARY OF THE INVENTION

For this, the method of the indicated type is characterised in that for the treatment of metal deposition an electrolytic bath is used which, in addition to the usual constituents, contains at least one chemical compound having brightener, properties.

By adding brighteners properties which are desired for specific applications can be imparted to the metal deposit.

For example, the hardness and the internal tension of the metal deposit, for example a nickel deposit, are influenced by adding sulphur-containing brighteners.

As a result of such a brightener addition the hardness increases, while the internal tension decreases.

In particular, a chemical compound having the properties of a second class brightener is used in the method according to the invention.

Such a specific brightener addition is important in connection with the fact that for many applications it is important that the specific surface area of the foam material is as large as possible in order to provide the substances interacting with the foam material with the maximum possible chance for reaction and/or attack.

It has been found that by incorporating a chemical compound having the properties of a second class brightener in the electrolytic metal bath, an explicit preferential growth of metal takes place which in general will occur mainly in a direction which is parallel to the shortest connection between the anode and the cathode of the electrolysis bath in which the foam material to be covered by a metal deposit and having an electrically conducting surface layer is installed as the cathode.

As will be seen below, the direction of preferential growth is not restricted to the above-mentioned direction.

When brighteners in general are used, such as mentioned above, for example a first class brightener, an all-round uniform growth is obtained and the spectrum of physical and/or mechanical properties can be adjusted by influencing the process conditions during growth.

With respect to the method, it is also pointed out that the foam material used as starting material can, on the one hand, be an organic foam material, such as a polyurethane, polyester, polystyrene, polyethylene, polyphenol, polyvinyl chloride or polypropylene foam; said foam is provided with a first metallisation layer by cathode sputtering, chemical metallisation or by decomposition of gaseous metal carbonyl compounds.

However, the foam starting material can also consist of a fibre assembly consisting of organic fibres which are provided with an electrically conducting surface layer by the above-mentioned metallisation processes. The foam starting material can, however, also be formed from organic fibres having electrical conductivity or consist of metal fibres.

In the last-mentioned cases the application of an electrically conducting surface layer is not necessary and can be dispensed with. The electrically conducting surface layer may instead of comprising a metal also be composed of an electrically conducting ceramic material such as titanium-nitride, tungsten carbide etc. The foam starting material may instead of comprising an optionally electrically conducting organic material or metal also comprise an electrically conducting ceramic material or a non conducting ceramic material comprising an electrically conducting metal or ceramic top layer. All of the above-mentioned materials having a porous structure are considered to be able to be processed with the aid of the method according to the present invention to provide a material having a metal foam structure, an important property being that the specific surface area (number of square meters of free metal surface per unit weight of the finished metal foam) is large compared with that of a corresponding metal foam which has been obtained using the method according to the prior art.

For the rest it is noted that the use of electrolysis baths which contain the chemical compounds described above is known per se from European Patent EP-B1-0038104 for the production of sieve materials. Said publication makes no mention of the possibility of forming metal foam materials having a greatly enlarged specific surface area and predetermined specific shapes.

For a review of chemical compounds which have the properties of a second class brightener and which can possibly be used reference is made to Modern Electroplating by Frederic A. Lowenheim; third edition 1973; John Whiley & Sons, page 302 and J. K. Dennis and T. E. Such; Nickel and Chromiumplating; Butterworth, second edition 1986, specifically Chapter 5 (Bright Nickel Electroplating).

In particular, the above-mentioned chemical compound is selected from second class brighteners and brighteners which have both second class properties and first class properties or from mixtures of two or more of such compounds.

For a definition of the difference between first and second class brighteners reference is made to the above mentioned literature references.

Advantageously, the chemical compounds which can be used in the present invention are chosen from 1,4-butyndiol and ethylenecyanohydrin as representatives of brighteners having second class properties and 1-(3-sulphopropyl)-pyridine and 1-(2-hydroxy-3-sulphoproply)-pyridine as second class brighteners having also the properties of first class brighteners.

In order to obtain an additionally enlarged specific surface area of the metal foam, the metal deposition treatment is highly advantageously carried out using one or more of the following conditions:

flow of bath fluid through the openings in the foam material for at least part of the period of metal deposition, and the use of a pulsating current during metal deposition, which comprises pulsating current periods (T) and currentless or reverse pulsating current periods (T'), T and T' being adjusted independently of one another to between 0 and 9,900 msec.

By using forced flow of the bath fluid through the openings which are present in the foam material or by using a pulsating current during metal deposition, a preferential growth can be obtained which is very explicit and which is reproducible in the realization.

In the case of use of flow of the bath fluid, a preferential growth is generally obtained which is parallel to the direction of flow of the bath fluid fed through the openings.

The applicable forced flow of bath fluid can be adjusted in several ways.

A. Flow with a Reynolds number of $\leqq$2,100; the preferential growth character is expressed most strongly in the case of this laminar flow.

B. In the case of flow with a Reynolds number of between 2,100 and 4,000 the specific growth form is an explicit function of the concentration of the brightener having second class properties.

C. Above Re 4,000, in the region of turbulent flow, the uniformity of the preferential growth will be affected and the character thereof will be highly dependent on the location inside the foam material.

By using a pulsating current, a preferential growth which can be varied within very wide limits can be obtained by adjustment of the pulsating current and currentless or reverse pulsating current periods. It is known that an increase in the scattering power of an electrolytic metal deposition bath, that is to say the quality of the metal distribution of the bath, can also be determined to a great extent by the use of a current modulator; the method is then known as pulse-plating. By means of a suitable choice of the modulator setting, the growth ratio R, as defined below, can be influenced over a wide range between R=1 (homogeneous all-round) and highly preferential R>>1 to infinity.

For the rest it is noted that the degree of preferential growth is generally indicated by the so-called growth ratio R which is equal to the total of the growth parallel to the connection line between the anode and cathode, or else the direction of flow, divided by the total of growth in a direction perpendicular thereto.

Of course, the growth characteristic discussed above can also be influenced by using both forced flow of the bath fluid and pulse-plating techniques.

For example, when growing a wire of circular cross-section in a conventional nickel bath the growth ratio will be approximately 1; when growing in a bath which contains a compound having the properties of a second class brightener, the said growth ratio can be between 1.5 and 5, while when forced flow of the bath fluid is used growth ratios of between 1.5 and, for example, 25 or more can be obtained. It is remarked that anyway the use of forced flow of the bath fluid during metal deposition and also the use of a pulsating current are known per se from EP-B-0049022 and EP-B-0079642. For details with regard to the procedure to be followed reference is made to the said publications. However, the said publications relate to the formation of a sieve material and do not relate to the production of a metal foam which can be used as electrode material or support material for an electrode; support material for a catalyst or otherwise sound-insulating material, and the like. When forced fluid flow is used through the pores of the foam material which is provided with an electrically conducting surface layer, the direction of flow of the bath fluid with respect to the foam material will advantageously be varied during the metal deposition treatment in order to apply several preferred growth directions to the system during the growth treatment. A variation of this type can relate, for example, to a reversal of the direction of flow for a certain time; however, it is also possible to choose a large number of different directions spread over the total growth time, as a result of which the metal foam, should this consist of wires of circular cross-section, can show a plurality of locations of different preferential growth around said cross-section.

The method described above can be used for all metal depositions with the aid of electrolysis which are known in the prior art; as a result of its broad field of application, the method will very frequently be used for the deposition of nickel.

In the above, the metal deposition step in an electrolysis bath is always indicated as the final treatment with regard to the use of an organic foam material as starting material.

However, it is also possible to apply a top layer after the metal deposition step, the top layer having properties which are desired for the later use of the metal foam. There are many materials which are suitable as a top layer, but preferably the top layer consists of chromium, phosphorus-nickel, nickeldisperse, gold or silver.

It is obvious that, if desired, the method can also be supplemented by a heat treatment step, following the metal deposition, the purpose of which is to remove the organic foam material internally present, for example by means of pyrolysis.

If the metal deposition in the final form would contain sulphur originating from, for example, a brightener having both first class and second class properties, it can be advantageous to perform a pyrolysis treatment preceding the metal deposition and following the application of the thin conducting layer which by then naturally has to be strong enough to maintain the shape of the foam.

Instead of pyrolysis the starting foam can be removed, for example, with a suitable solvent.

The heat treatment conditions can also be chosen such that sintering of the deposited metal takes place, so that the structure is even more mechanically strengthened.

The invention also relates to a metal foam obtained by means of the method described above, which metal foam is characterised in that the foam material is an open-cell synthetic foam, such as a polyurethane foam, which has an electrically conducting surface layer composed of a metal such as nickel or copper and having a thickness of from 0.1 to 5 micrometers, in particular 0.1 to 1 micrometer, and which is covered by a nickel layer which has a maximum thickness of from 5 to 250 micrometers, in particular 10 to 50 micrometers.

The metal foam produced by means of the method of the invention has very advantageous properties, depending on the production conditions.

By using an electrolytic metal deposition treatment in the presence of a substance having the properties of a second class brightener, a preferential thickening is achieved, as a result of which the resistance to bending increases.

By using specific suitable types of metal, such as phosphorus-nickel and cobalt-nickel, the metal can be given greater hardness and higher wear resistance; the said types of metal can also be precipitated during part of the metal deposition period.

The use of substances having second class brightener properties also leads to the surface of the precipitated metal being smoother and brighter than is the case when a bath is used which does not contain these substances.

The advantageous properties described above can also be enhanced by the use of the measures described in the subclaims, such as metal deposition using forced flow of the electrolyte bath fluid and the use of a pulsating current during the metal deposition.

Under the two last-mentioned conditions a highly preferential growth is possible, as a result of which pores which have an axis essentially parallel to the direction of preferential growth retain essentially the same cross-sectional dimension.

Finally, the present invention relates to a metal foam, comprising a core form around which a metal layer is present, the cross-section of the core form being determined by a foam starting material which optionally is still present in the metal foam. This metal foam is characterised in that in at least a part of the metal foam the shape of the outer limitation of the metal layer mainly deviates from the shape of the outer limitation of the foam starting material applied.

BRIEF DESCRIPTION OF THE DRAWINGS

The invention will now be described in the light of the appended drawings, in which:

FIG. 3 shows a similar element which has been thickened with the use of forced fluid flow and/or pulsating current.

DETAILED DESCRIPTION OF THE INVENTION

Figure 2:
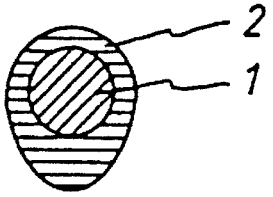
FIG. 2 shows a cross-section of a foam element thickened by means of a method in another embodiment.
Figure 1:
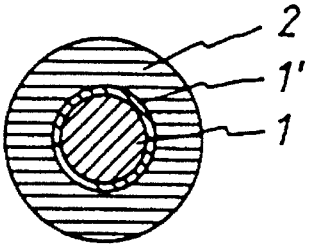
FIG. 1 shows a cross-section of a foam element thickened by means of the method in a first embodiment.

In FIGS. 1 and 2 a cross-section of a foam component 1 is shown schematically. The foam, for example a polyurethane foam, has been provided with a conducting surface layer 1' (FIG. 1) in a manner disclosed in the prior art, for example by currentless nickel-plating or copper-plating, decomposition of nickel carbonyl, cathode sputtering or the like. In a typical example, a thus formed conducting surface layer is 1 micrometer thick; the synthetic foam material rendered conductive in this way is inserted as a cathode in a nickel bath. The nickel bath which was used for plating the foam element in FIG. 1 contained 150 mg/l of disodium-salt of meta-benzenedisulphonic acid, while for the foam element in FIG. 2 the nickel bath contained 80 milligrams of 1,4-butyndiol per liter. A nickel deposit 2 is formed, as can be seen in FIG. 2, a preferential growth on the underside of the filament 1 being clearly discernible; a similar preferential growth is not observed if the bath does not contain the above-mentioned chemical compound 1,4-butyndiol, as can be seen from FIG. 1.

Apart from the brightener constituents the bath can be a conventional Watt's bath which is well known in the art.

The conducting surface layer 1' is not drawn in FIG. 2 and the subsequent figures, but is present. After the plated foam element is finished, the synthetic foam core can be removed by pyrolysis.

FIG. 3 shows a situation as indicated in FIG. 1, the deposit 2 showing an even clearer preferential growth in the form of a bulge 3; this highly preferential growth is the consequence of the application of a bath fluid flow which in the figure is directed parallel to the long side of the paper.

Figure 4:
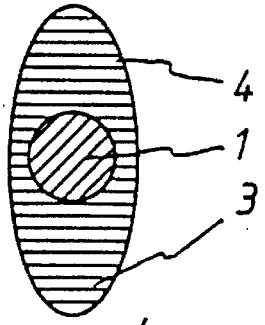
FIG. 4 is as FIG. 2 but using a fluid flow varied in two directions or adjusted pulsating current.

FIG. 4 shows the situation from FIG. 3 but in this case a bath fluid flow in the downwards direction parallel to the long side of the paper was maintained during a first period of the time whereas a bath fluid flow which was directed upwards parallel to the long side of the paper was applied during a second period; bulges 3 and 4 are obtained in this way.

Figure 5:
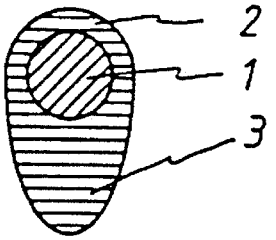
FIG. 5 is as FIG. 3 but using various differing directions of flow of the bath fluid or pulsating current settings.
Figure 5:
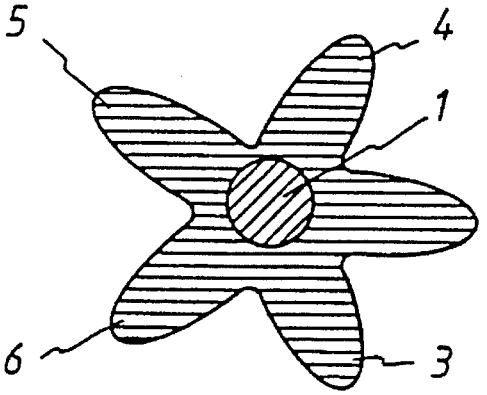

Finally, FIG. 5 shows a situation in which a forced flow of the bath fluid which was varied in different directions has been produced during the precipitation treatment, which leads to the formation of a number of irregularly shaped bulges 3, 4, 5 and 6.

The situations described above are the consequence of the use of a forced flow of the bath fluid in a bath which contains at least one chemical compound having at least the properties of a second-class brightener. The said effects can also be obtained by the use of a pulsating current; by using a pulsating current under certain circumstances, a very strong preferential growth in a chosen direction can be achieved.

Depending on the additive, in the form of a brightener, which is chosen for the metal deposition, the following properties can be influenced:

strength of the finished material surface structure tensile strength dimensional stability characteristics hardness wear resistance corrosion resistance.

By carrying out a sintering treatment on the finished material at elevated temperature and preferably in an inert gas environment, the cohesion can also be greatly improved; in such a case the brightener should preferably be a sulphur-free brightener such as, for example, 1,4-butyndiol or ethylene cyanohydrine.

In the case of a synthetic foam starting material where removal of the synthetic core is desired, the sintering treatment can be preceded by or followed by a pyrolysis treatment.

Here also applies that when the metal deposition in the final form contains sulphur the pyrolysis treatment advantageously is performed instantly after the application of the first thin conducting layer..

With regard to the use of the material obtained by means of the method according to the invention, mention is also made, in addition to the above-mentioned applications, of the possibility for the use of such materials, if necessary after removal of an organic foam material which has been used, as material for protection against electromagnetic radiation; as construction material and as filter material for the selective galvanic purification of electrolysis baths. However, the applications are not restricted to the applications given above; those skilled in the art will have many other applications in view.

What is claimed is:

1. A metal foam obtained by means of a method comprising the steps of providing a foam starting material and subjecting the foam starting material to a treatment of metal deposition in an electrolytic bath which comprises an effective amount of at least one unsaturated organic second class brightener in order to preferentially deposit metal onto the foam starting material, wherein the foam starting material is an open-cell synthetic foam having an electrically conducting surface layer composed of a metal and having a thickness from 0.1 to 5 μm, and which electrically conducting surface layer is covered by a nickel layer which has a maximum thickness of from 5 to 250 μm.

2. A metal foam as defined in claim 1, wherein the electrically conducting surface layer is selected from the group consisting of nickel and copper.

3. A metal foam as defined in claim 2, wherein the electrically conducting surface layer has a thickness of 0.1 to 1 μm and the nickel layer has a thickness of 10 to 50 μm.

4. A metal foam according to claim 1 which has been heat-treated following the metal deposition, in order to remove the synthetic foam starting material.

5. A metal foam obtained by means of a method comprising the steps of providing a synthetic foam starting material and subjecting the foam starting material to a treatment of metal deposition in an electrolytic bath which comprises an effective amount of at least one unsaturated organic second class brightener in order to preferentially deposit metal onto the foam starting material, said metal foam comprising a core form around which a metal layer is present, the core form having a shape which is determined by the foam starting material, wherein in at least a part of the metal foam the metal layer has a shape which substantially deviates from the shape of the core form.

6. A metal foam according to claim 5 wherein the core form is the foam starting material.

7. A metal foam according to claim 5 wherein after the shape of the core form has been determined by the foam starting material, the foam starting material is removed.

* * * * *